US008276375B2

(12) United States Patent
Plough

(10) Patent No.: US 8,276,375 B2
(45) Date of Patent: Oct. 2, 2012

(54) DOWNFORCE-PRODUCING EXHAUST HEADER

(76) Inventor: Samuel Plough, Anderson, CA (US)

( * ) Notice: Subject to any disclaimer, the term of this patent is extended or adjusted under 35 U.S.C. 154(b) by 1221 days.

(21) Appl. No.: 11/949,944

(22) Filed: Dec. 4, 2007

(65) Prior Publication Data

US 2008/0134673 A1 Jun. 12, 2008

Related U.S. Application Data

(60) Provisional application No. 60/874,747, filed on Dec. 12, 2006.

(51) Int. Cl.
*F01N 1/00* (2006.01)

(52) U.S. Cl. ..... 60/323; 60/274; 60/322; 60/324

(58) Field of Classification Search ..... 60/274, 60/316, 317, 322, 324, 323; 239/288.3, 500, 239/505, 516
See application file for complete search history.

(56) References Cited

U.S. PATENT DOCUMENTS

| | | | | | |
|---|---|---|---|---|---|
| 2,123,858 | A | * | 7/1938 | Wightman | 239/288.3 |
| 2,260,841 | A | * | 10/1941 | Russell | 239/500 |
| 2,466,307 | A | * | 4/1949 | Di Renna | 239/516 |
| 2,674,087 | A | * | 4/1954 | Russell | 239/430 |
| 2,677,929 | A | * | 5/1954 | Russell | 239/505 |
| 3,940,097 | A | * | 2/1976 | Wilson et al. | 244/23 D |
| 4,335,575 | A | * | 6/1982 | Pagliuca | 60/319 |
| 4,903,484 | A | * | 2/1990 | Yates et al. | 60/316 |

* cited by examiner

*Primary Examiner* — Thomas Denion
*Assistant Examiner* — Diem Tran
(74) *Attorney, Agent, or Firm* — Donald R. Boys; Central Coast Patent Agency, Inc.

(57) ABSTRACT

An exhaust system has one or more exhaust tubes having a first diameter, interfaced to an exhaust manifold at one end and open at an opposite end for exhaust gas to escape, and a tubular extension of a second diameter, larger than the first diameter, joined to the open end of individual ones of the exhaust tubes, the extension cut at an angle with vertical and joined to the exhaust tube in a manner that exhaust gas expanding at the open end is free to expand upward, but expanding downward strikes the tubular extension, creating a downward force on the exhaust system.

8 Claims, 5 Drawing Sheets

DOWNFORCE-PRODUCING EXHAUST HEADER

CROSS-REFERENCE TO RELATED APPLICATIONS

The present invention claims priority to a U.S. provisional patent application Ser. No. 60/874,747, entitled Downforce-Creating Exhaust Header filed on Dec. 12, 2006, disclosure of which is included herein in its entirety at least by reference.

BACKGROUND OF THE INVENTION

1. Field of the Invention

The present invention is in the field of aftermarket automotive products, and pertains more specifically exhaust headers adaptable to racing motors.

2. Discussion of the State of the Art

In the field of automotive products, particularly automotive racing products, there are a wide variety of products available that intend to provide certain performance factors to a race car that would not otherwise be available with stock automotive engine and exhaust parts and assemblies.

Performance factors in racing are gauged by measuring key performance indicators (KPIs) that are prevalent when a race car is in performance mode. For example, downforce is a KPI that is defined as the downward directional force against a moving race car. Downforce measurement is relative to speed and increases when speed increases and decreases when speed decreases, assuming that the downforce is created by after market foils and/or modifications in chassis design. One challenge in performance enhancement of racing vehicles is finding a suitable mix of products that together optimize performance in a way that does not reduce or limit the goal of performance maximization. Downforce is desired because it works to benefit traction of the vehicle at higher speeds; however, some increase of resistance relative to airflow of the vehicle may be a byproduct of improving tire-to-track traction at higher speeds.

Therefore, what is clearly needed in the art is a method and apparatus for creating downforce in a racing vehicle that does not affect the streamlining or airflow properties of a racing vehicle.

SUMMARY OF THE INVENTION

The problem stated above is that downforce is desirable for a racing vehicle, but many of the conventional means for creating downforce, such as spoilers, also create drag. The inventors therefore considered functional elements of a racing vehicle, looking for elements that exhibit moving mass that could potentially be harnessed to provide downforce but in a manner that would not create drag.

Every racing vehicle is propelled by internal combustion, one by-product of which is an abundance of exhaust gases expelled from the engine under pressure. Most such engines employ exhaust headers and manifolds to conduct the exhaust gases from the exhaust ports of the engine to a more realistic point to expel the gases, and exhaust pipes are typically a part of such apparatus.

The present inventor realized in an inventive moment that if, at the point of expansion, exhaust gases could be caused to impinge in a downward direction on surfaces attached to the vehicle, significant downforce might result. The inventor therefore constructed a unique extension arrangement for exhaust pipes at the open ends that allowed gases to expand freely upward, but constrained exhaust gases expanding downward to strike extensions to the exhaust pipes. A significant downforce results, with no impediment to motion or drag created.

Accordingly, in one embodiment of the invention an exhaust system is provided, comprising one or more exhaust tubes having a first diameter, interfaced to an exhaust manifold at one end and open at an opposite end for exhaust gas to escape, and a tubular extension of a second diameter, larger than the first diameter, joined to the open end of individual ones of the exhaust tubes, the extension cut at an angle with vertical and joined to the exhaust tube in a manner that exhaust gas expanding at the open end is free to expand upward, but expanding downward strikes the tubular extension, creating a downward force on the exhaust system.

In another embodiment an exhaust system is provided comprising a plurality of first exhaust tubes having a first diameter, interfaced to an exhaust manifold at one end and opening at an opposite end into a single second exhaust tube or chamber, and tubular extensions of a second diameter, larger than the first diameter, joined to the open end of individual ones of the exhaust tubes inside the second exhaust tube or chamber, the extensions cut at an angle with vertical and joined to the exhaust tubes in a manner that exhaust gas expanding at the open end is free to expand upward, but expanding downward strikes the tubular extension, creating a downward force on the exhaust system.

These and more detailed embodiments of the invention are taught in enabling detail below.

BRIEF DESCRIPTION OF THE DRAWING FIGURES

DETAILED DESCRIPTION

The inventor provides an exhaust header for racing vehicles that when in use, creates a significant downward force or downforce to the host vehicle improving tire-to-track traction at higher racing speeds without affecting airflow properties of the vehicle.

The invention is described in enabling detail below.

Figure 1:
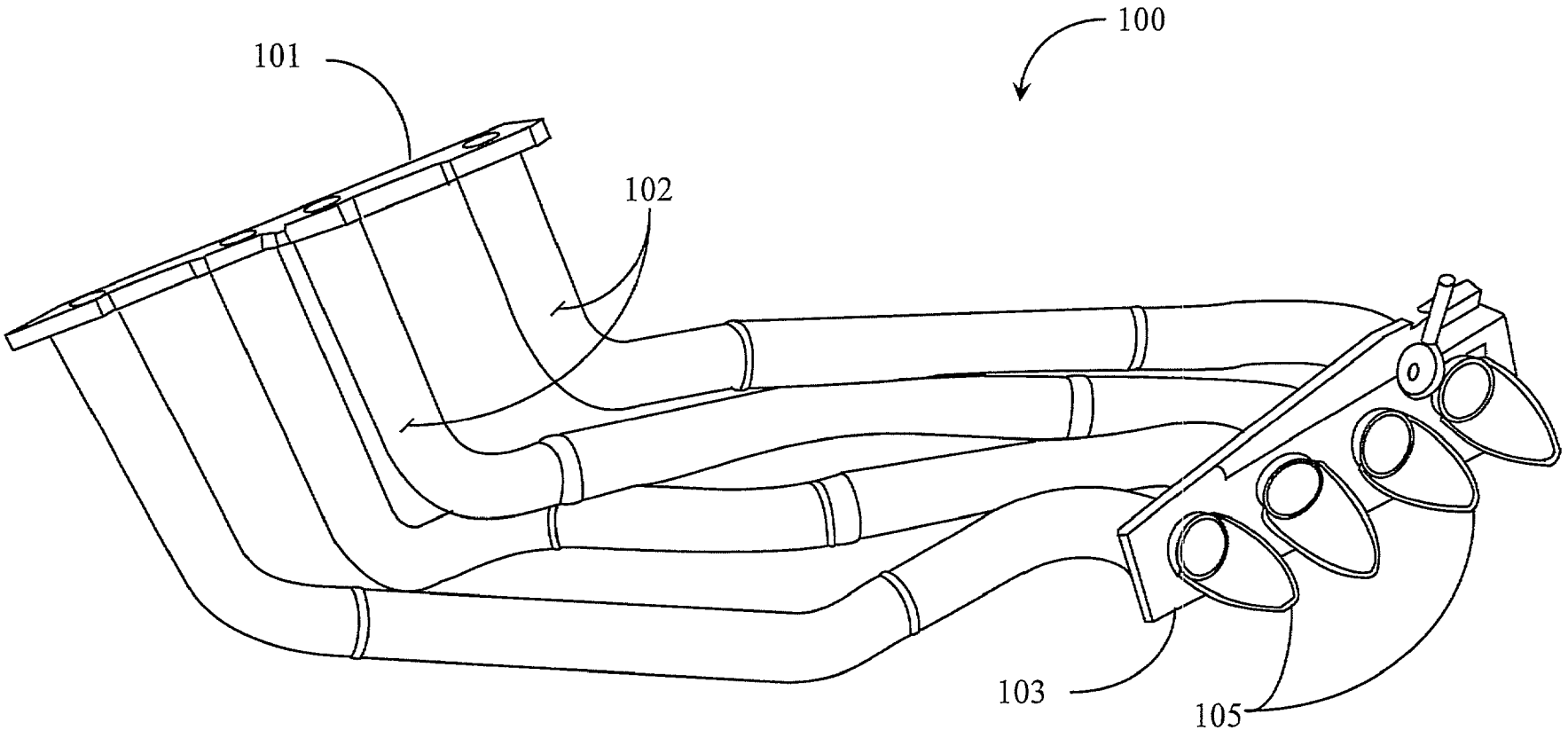
FIG. 1 is a perspective view of a downforce producing exhaust header according to an embodiment of the present invention.

FIG. 1 is a perspective view of a downforce-producing exhaust header according to an embodiment of the present invention. Referring now to FIG. 1, a downforce-producing header system 100 has an exhaust flange 101 designed to bolt onto the exhaust port of a vehicle. Exhaust flange 101 is a machined steel flange and provides a fixture for staging exhaust pipes 102, of which there are four in this example. Exhaust pipes 102 may be provided of formed steel sections of tubing, which are welded together to form each length of exhaust pipe. In one embodiment, exhaust pipes 102 are typically round, although a section of each pipe may be deformed intentionally into an egg shape profile for a specific reason discussed further below.

Header system 100 in this example is only half of a complete system mounted on one side of a vehicle exhaust. Two exhaust headers are typically provided, one for each exhaust port of the vehicle engine. It is important to note herein that the exact number of exhaust pipes included in header system 100 may vary according to design and the vehicle engine, the system will mount to. Specific bend patterns are also a customizable feature.

At the free end of exhaust pipes 102, a collector, or stabilizing flange 103 is provided to gather and stabilize the exhaust pipes at the gas exhaust end. Collector flange 103 is machined steel in this example and may be welded to the pipe ends once installed. In other embodiments, other types of durable metals may be used to fabricate system 100.

In a preferred embodiment, the inventor provides a plurality of angle-cut tubes 105, which may be welded or otherwise attached to the ends of each pipe 102 of header system 100. Angle cut tubes 105 are strategically spaced from the outside wall of each exhaust tube so that there is a measurable step from the inside wall of the exhaust tube to the inside wall if the angle-cut tube section. The existence of the step is important to the function of the present invention.

Angle cut tube ends are cut from a tubing section having an inner diameter as large or larger than the outer diameter of the exhaust tubes 102 so that the radius of angle-cut tube 105 is larger than the radius of exhaust tubing 102. In this example, angle-cut tube sections 105 are each welded to the outside end of exhaust tubes 102 such that the inner wall of the angle-cut tube faces up and the outside surface faces down. In one embodiment, all of the angle-cut tubes 105 are oriented in the same inner direction. However, this is not absolutely required to practice the invention, for example, the collection of angle-cut tubes do not have to line up perfectly. Likewise, they do not have to be stabilized together using one collection flange. For example, in some designs having four exhaust tubes emanating from one side of the engine, two of those exhaust tubes may be shorter than the other two without departing from the spirit and scope of the present invention. In that case, more than one collection flange or other stabilization plate or bar could be provided.

The angle of cut for the angle-cut tubes may be approximately 15 to 25 degrees from horizontal in one example. In other embodiments other cut angles may be used without affecting the function of the system. In use of the present invention, as an engine runs, each cylinder fires repeatedly. The frequency of each cylinder firing and exhaust cycle, of course is a controlled function to maximum RPM capability of the engine. The aggregate of cylinders firing at high revolutions per minute creates a downward force at the end of exhaust tubes 102 due to expanding exhaust gasses acting against the angle-cut tubes 105. At higher engine speeds, the force created acts as a stable and constant force.

The dynamics of the generated downward force change with acceleration of the vehicle engine. At high RPMs the force is much greater than at lower RPMs. Variables that contribute to the measure of force created include the temperature of the gas, the velocity of the gas, the frequency of firing of the cylinders, and the rate of expansion of the gas as it leaves the confinement of exhaust tubes 102. Angle cut tubes 105 are strategically spaced apart from the outer walls of exhaust tubes 102 in order to create a step called a hammer step by the inventor. The distance between the inner wall of an exhaust tube 102 and the inner wall of the angle cut tube 105 provides a span enabling the expanding gas to gain velocity in expansion before concussively striking the angle-cut tube section. The repeating cycle of this hammer effect governed for each tube by the RPM of the vehicle engine provides substantial downward force. At higher RPMs, the force is a relative constant downward pressure on each exhaust tube end.

In one embodiment, tubes 102 come in two or more tube sections that are welded together as described above to form a complete length of an exhaust tube. In this example, there are 3 tube sections welded together to form each tube 102. In a preferred embodiment, each successive tube section has an inner diameter slightly larger than the previous tube section. The exact diameters of all of the sections may vary according to design, engine specifications, horsepower and other considerations. However, a typical outer diameter progression of welded tubing sections based on a same tubing wall thickness for all the sections may be exemplified as a one and seven-eighths inches diameter, followed by a two inch diameter section followed by a two and one eighth inch diameter section.

In one embodiment, one exhaust tube section that tapers gradually out along its length may be provided instead of subsequently larger tubing sections welded together, but for economic convenience, the latter is preferred. It is noted herein that provision of a tubing diameter that is too large for a specific application (engine specification) may result in the gas taking on density, cooling, and slowing down possibly increasing backpressure and reducing performance. Therefore, the major diameter is held small enough relative to application to prevent the risk of densification of gases at or before the output of the exhaust tube.

For general purposes it is also preferred that tubes 102 have as few bends as is practical and that the bends in the tubing are formed as smoothly as possible in order to reduce backpressure on the exhaust. Subsequent larger diameter tubing sections also serves to help reduce backpressure.

It was described above that other general tubing shapes may be used for one or more tubing sections instead of a round tubing section. One property of the gas flow that may develop as gas is forced through the exhaust tubing is that it may begin to spiral as water does when falling through a round pipe. Therefore, application of an egg shape or elliptical tubing section, or a rectangular shaped section placed strategically in the length of tubing (middle tube section) prevents gas spiraling effect, enabling the exhaust gas to move with less resistance and greater speed through the exhaust. In one embodiment, adapter flanges are provided to connect tubing sections having different tube profiles together. It is important to note herein that such flanges should be manufactured such that a smooth transition from one shape of tubing to another is achieved to reduce friction.

The inventor has found that introducing an elliptical or egg-shaped section after about 18 inches of exhaust tube is sufficient to prevent spiraling of gases. Other shapes may also be used instead of an ellipse such as a rounded rectangle or a rounded square shape. For economic consideration rectangular tubing may be used because of its ready availability. Although not essential in practice of the present invention, reducing or preventing gas spiraling through the exhaust optimizes the downward force created at the end of the exhaust tube by virtue of greater speed and volume of gas escaping the tube which creates a faster expansion.

For a typical racing engine there are 8 points of downward force when using an exhaust manifold according to one embodiment of the present invention, 4 on each side of the vehicle engine. In other embodiments, other numbers of tubes may be provided and the locations of those points of force may be regulated by design of the header system. The present invention may be applied to stock cars and other types of racing cars including drag racers. In one embodiment, the methods and apparatus of the present invention can be modified for use on two wheeled and three wheeled motorcycles. There are many possibilities.

Figure 2:
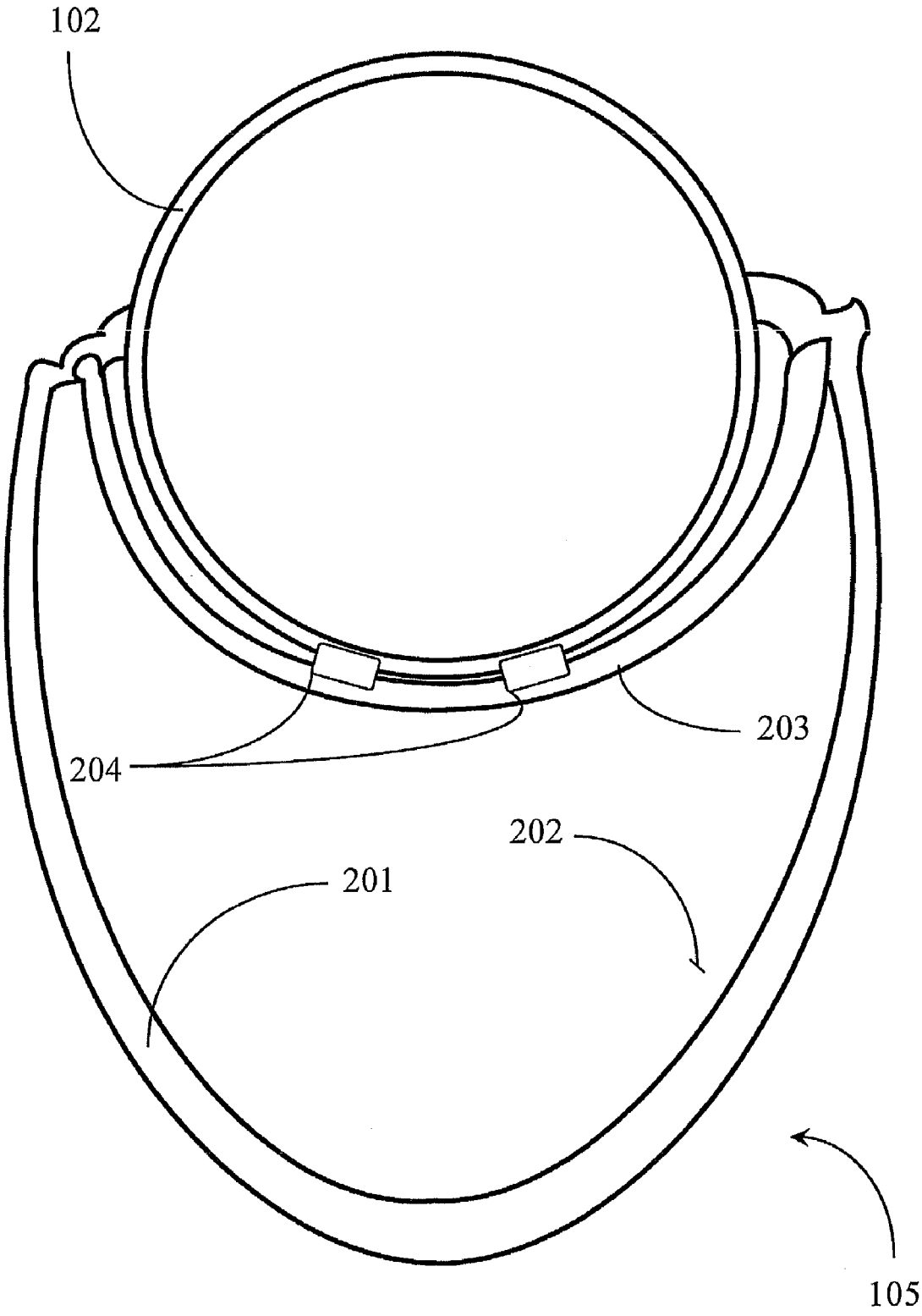
FIG. 2 is an end view of one of the exhaust tubes 102 of FIG. 1.

Referring now to FIG. 2, angle-cut tube section 105 is, in this embodiment, welded to the sides of exhaust tube end of exhaust tube 102. A hammer step spacer 203 is provided between the outer wall of exhaust tube 101 and the inner wall 202 of angle-cut tube 105 to achieve the concussive distance for the hot, expanding exhaust gasses to travel before hammering the inner wall of angle-cut tube 105. The angle-cut line 201 extends forward past the end of exhaust tube 102. Spacer 203 may be a strip of tubing of a desired radius cut off the end of the tubing and then sectioned to length. Welding points 204 illustrate attachment of the spacer to the outside wall of exhaust tube 102. Additional weld points may be required as needed to secure the assembly.

The distance of the hammer step may vary depending upon the application. A quarter of an inch or less is sufficient spacing for most applications. It may be noted that regulating the distance of the hammer step may be desired as providing too much gap allows the expanding gasses to slow down before hitting the inner wall of the angle-cut tube and providing two little a gap does not allow the gas to reach peak velocity before striking the "hammer". Therefore, the exact spacing may vary according to the exact application and desired goal.

Figure 3:
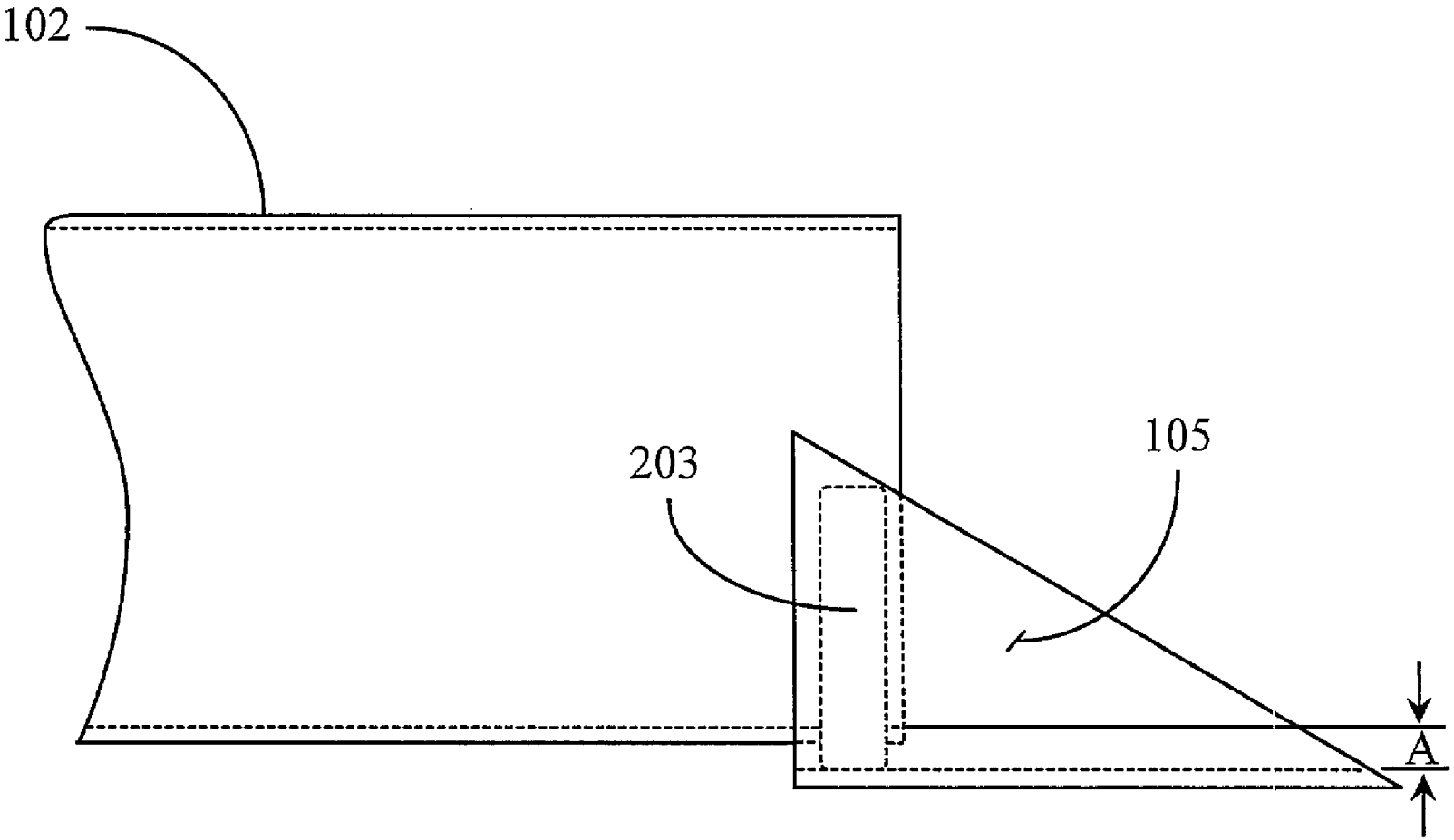
FIG. 3 is a side view of the end of one of exhaust tubes 102 of FIG. 1.

Referring now to FIG. 3, exhaust tube 102 is viewed from the side to illustrate the profile of angle-cut tube 105, attached by welding in this example to the exhaust tube end. In this example the walls of tube section 105 and the walls of exhaust tube 101 are substantially parallel. Spacer 203 provides the hammer step distance, which in this example, is illustrated by dimension A. Dimension A is measured from the inside wall of tube 102 to the inside wall of tube section 105.

In one embodiment of the present invention, angle-cut tube section 105 is adapted to be assembled to the end of exhaust tube 102 using a flange clamp, bolt pattern, or some other assembly method and hardware. In this embodiment, the hammer space A may be individually adjustable by replacing and inserting spacers of varying thicknesses and then tightening the assembly over tube 102. Other methods of adjustment may be applied such as by thumb screw spacing; by turning a bolt; and so on. In an adjustable embodiment, there may be eight points of adjustment, 4 on each side of a vehicle chassis. An 8-point adjustment system enables distributing of downforce evenly with respect to both sides of the exhaust system thereby applying better stabilization of downforce relative to the rear tires of the vehicle.

Figure 4:
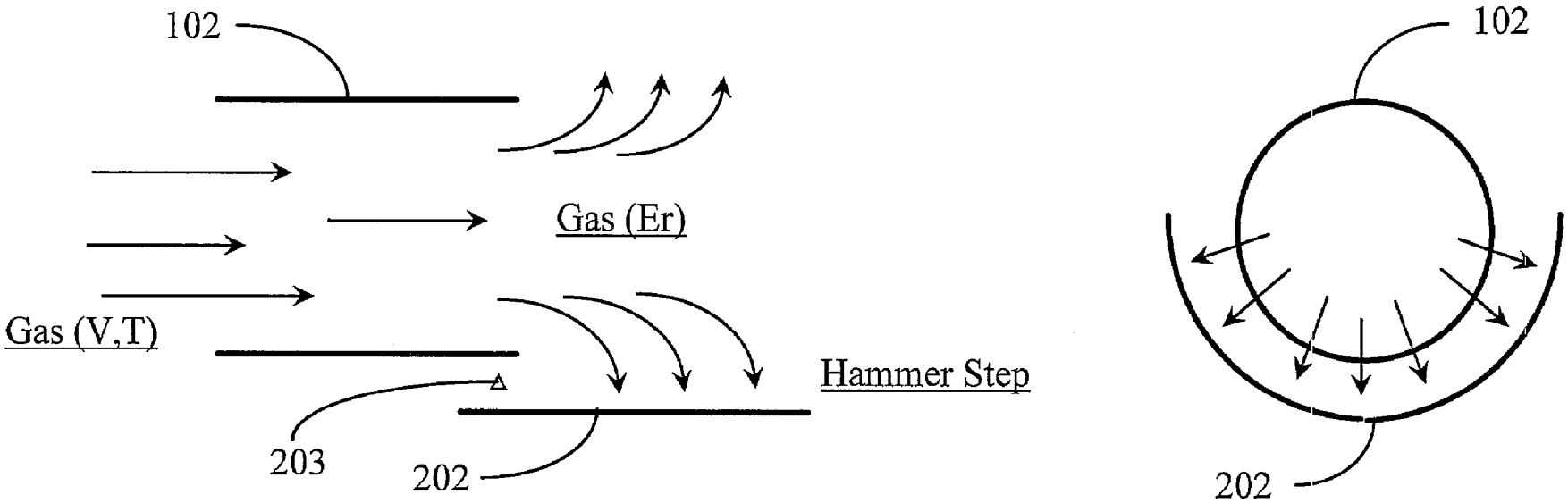
FIG. 4 is a flow diagram illustrating gas flow and expansion characteristics of gas escaping an exhaust tube 102 of FIG. 1 according to an embodiment of the present invention.

Referring now to FIG. 4, exhaust tube 102 is represented by parallel lines. Exhaust gas is illustrated traveling through tube 102 by directional arrows. Gas in the exhaust tube has a velocity (V) and a temperature (T). As the gas leaves the exhaust tube, it travels in the direction of the curved arrows. The gas has an expansion rate that is affected in part by the temperature of the gas at the point of expansion. Hammer step spacing is illustrated by space 203 and the inner wall 202 of the angle-cut tube. Gas is allowed to expand freely above the assembly, but expanding gas is stopped by wall 202, thus providing the downward force.

Therefore, the downward force exerted on wall 202 at peak expansion is a function of the diameter of the exhaust tube, the velocity, volume, and temperature of the gas traveling through the tube, the expansion rate of the gas after leaving the tube, and the distance the gas travels during expansion before hitting wall 202. The magnitude of the force can be regulated by several factors including changing the properties of the exhaust tube, changing the distance of the hammer step from the exhaust tube, and changing the RPMs of the engine. It is noted herein that the downward force is characterized by a force angle caused by the fact that the gas is traveling at a high rate of speed, as it exists the exhaust tube. In one embodiment, more downward force might be created by modifying the end of the angle-cut tube by turning up the edge to form a protruding lip. Another modification that may increase downward force might be to slightly angle the angle-cut tube upward in assembly before welding, perhaps 3 to 5 degrees from parallel.

In a separate view to the right, an end view shows the radial properties of the assembly. Hammer step surface 202 wraps radially around the exhaust tube 101. Therefore, the downward force extends radially to the extent of the angle-cut section permits. In one embodiment of the present invention all or a section of the exhaust pipe is modified to produce an egg shape profile instead or a round profile to prevent "riffling effects" to the gas traveling through the tube. This modification could enable the gas to arrive at the expansion point faster at a higher temperature contributing to a faster expansion rate producing more force on the hammer.

Empirical testing performed by the inventor has shown that the header of the present invention installed on the exhaust of a race car on a weigh scale produced up to 19 pounds of downward force on the vehicle at racing speeds with respect to RPMs.

In a particular embodiment of the present invention, as described above, an exhaust system is provided, comprising one or more exhaust tubes having a first diameter, interfaced to an exhaust manifold at one end and open at an opposite end for exhaust gas to escape, and a tubular extension of a second diameter, larger than the first diameter, joined to the open end of individual ones of the exhaust tubes, the extension cut at an angle with vertical and joined to the exhaust tube in a manner that exhaust gas expanding at the open end is free to expand upward, but expanding downward strikes the tubular extension, creating a downward force on the exhaust system.

Figure 5:
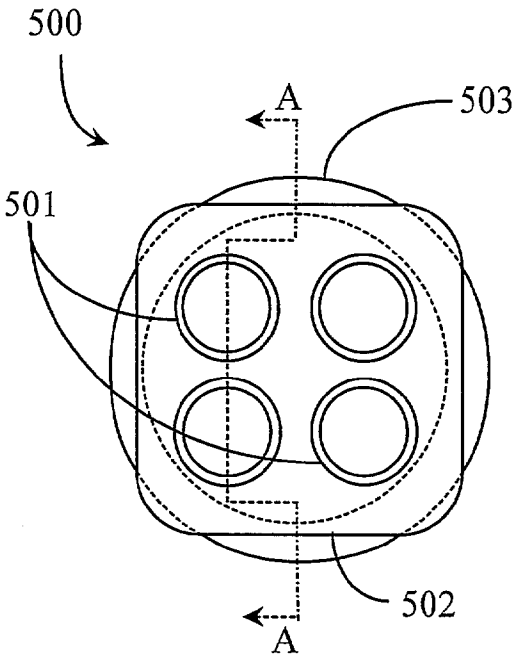
FIG. 5 is a front view of an exhaust collector adapted for downforce production according to another embodiment of the present invention.

FIG. 5 is a front view of an exhaust collector 500 adapted for downforce production according to another embodiment of the present invention. In one embodiment, exhaust header tubes such as tubes 102 described above are collected by an apparatus termed an exhaust collector in the art. An exhaust collector 500 is illustrated in front view in this example. Collector 500 is an apparatus that may be provided from stainless steel, aluminum, or some other durable metal.

Collector 500 has a substantially rectangular body 502 adapted to "collect" 4 of typically 8 exhaust tubes 501 in this example. Exhaust tubes 501 are analogous to exhaust tubes 102 described above adapted by bending for collector interface. For a complete header system comprising 8 exhaust tubes, there would typically be 2 collectors, one on each side of the vehicle chassis. The backside of collector 500 may be interfaced to a single round tube exhaust tube 503 of a significantly larger diameter than individual exhaust tube leading into the collector. Tube 503 may be annular tubing that tapers slightly outward from where it connects to the rectangular body portion of collector 500. A taper in tubing 503 is not required to practice the invention. Moreover, tubing 503 is not restricted to annular tubing. Likewise, collector body 502 is not restricted to being rectangular. There are a wide variety of different shapes and profiles available in exhaust collectors. Collector 500 may be formed typically of two pieces of stainless steel formed and welded together.

Body 502 may be a hollowed rectangular chamber closed on both ends and adapted similarly to a baffle for housing, in this case, 4 exhaust tubes 501 that enter through the front collector wall and terminate roughly at the other end of the collector body, perhaps extending slightly through the rear collector wall of collector body 502. Exhaust tubes 501 are round in this example and symmetrically gathered in a two-over-two rectangular configuration. Other collection configurations are possible such as a "diamond" configuration for example (pattern rotated 45 degrees).

In one embodiment, the ends of the exhaust header tubes are pressed into collector body 500 and elements 501 are in effect sleeves adapted to accept the tubing ends, the inside diameter of sleeves 501 just larger than the tubing ends. In one embodiment where elements 501 are sleeves, the inside shape of the sleeves may be other than round to accommodate a possibility of exhaust tubing that is other than round.

In one embodiment, collector body 502 is completely hollow and elements 501 or openings through the front collector wall to accept the exhaust tubing ends. In this case there is no wall at the other end of the rectangular body. It simply opens out to the tubing configuration of tubing 503.

Figure 6:
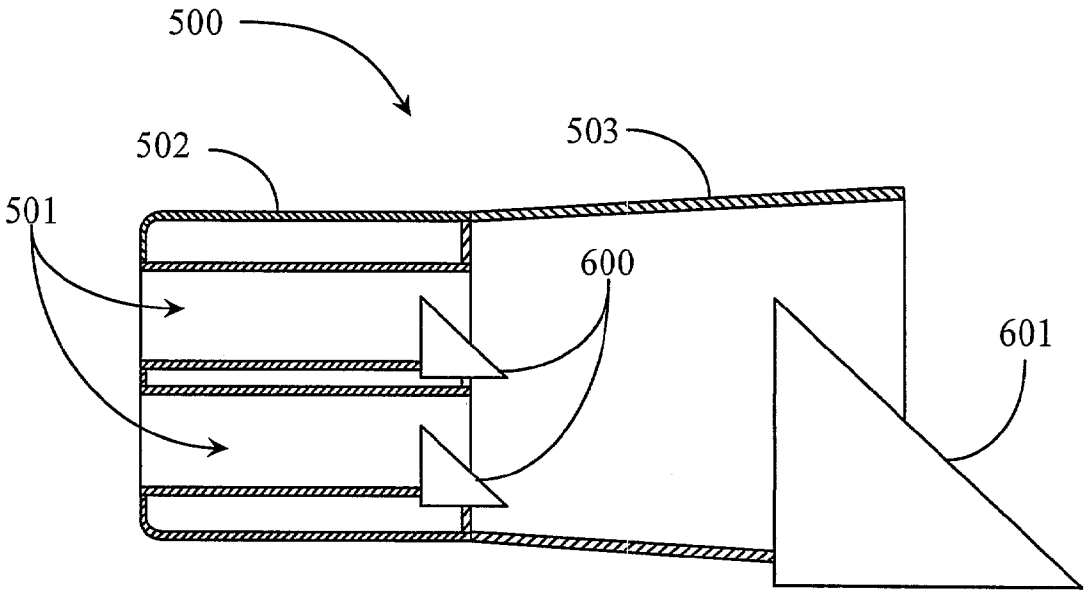
FIG. 6 is a side and sectioned view of the exhaust collector of FIG. 5.

FIG. 6 is a sectioned view of collector 500 of FIG. 5 taken along section line AA. As described above, exhaust collector body 502 houses exhaust tubes or sleeves 501, which extend in this case through the rectangular body 502 and open out to the larger single exhaust tube 503. In one embodiment of the invention there are 4 downforce "hammers" 600 provided, one for each exhaust tube entering the collector.

In an embodiment using exhaust sleeves or tubes extending completely through the body portion of collector 500 in the manner of a baffle, downforce hammers 600 may be placed at the end of each exhaust tube in a manner similarly to the one described above using an angled tube section 105 on the end of exhaust tube 102. In this example, hammers 600 are logically represented by block triangles representative of the angle cut tubing sections described further above. Relief may be provided through the back wall of body portion 502 for the hammers to be installed over the tube or sleeve ends. In a variation to this embodiment, hammer steps may be perpendicularly welded to the rear wall of the collector body just below each of the exhaust outlets. In this case, the downforce is created within tube 503 at the point of interface with the body portion of the collector.

According to the descriptions above an exhaust system is provided, comprising a plurality of first exhaust tubes having a first diameter, interfaced to an exhaust manifold at one end and opening at an opposite end into a single second exhaust tube or chamber, and tubular extensions of a second diameter, larger than the first diameter, joined to the open end of individual ones of the exhaust tubes inside the second exhaust tube or chamber, the extensions cut at an angle with vertical and joined to the exhaust tubes in a manner that exhaust gas expanding at the open end is free to expand upward, but expanding downward strikes the tubular extension, creating a downward force on the exhaust system.

In another embodiment, a single larger downforce hammer 601 is provided at the end of the final single exhaust tube 503. In this embodiment, the gas flows through tubes 501 and directly into and out of single exhaust tube 503 before downforce is created. Hammer 601 is logically represented here as described with respect to hammers 600. In still another variation, all illustrated hammers 600 and 601 may be present (5) hammers, one for each collected exhaust pipe and one for the final single exhaust pipe.

In one embodiment, the header exhaust pipes terminate at the front wall of body portion 502 of collector 500. In this case there is no rear wall and the collector is completely open from behind the front wall out of tube 503. Hammers 600 if provided in this variation would be strategically placed at the front wall of the collector body just under each exhaust outlet. In another variation the single hammer may be used as previously described. In still another, all 5 hammers might be provided. It is noted herein that the exact shape, profile, and installation method of a hammer may vary according to the collector design and shape of the exhaust tubes and the larger exhaust outlet of the collector. The inventor intends that the invention be adaptable to most existing racing exhaust collector designs. In one embodiment however, a new collector design may be provided to which the installation of hammers may be undertaken accordingly.

In all of the embodiments of the invention where hammers are installed, they may be installed in a manner that is adjustable as previously described. The invention can be used for any type of exposed exhaust systems for racing vehicles including motorcycles. There are many possibilities.

It will be apparent to one with skill in the art that the downforce header system of the invention may be provided using some or all of the mentioned features and components without departing from the spirit and scope of the present invention. It will also be apparent to the skilled artisan that the embodiments described above are specific examples of a single broader invention which may have greater scope than any of the singular descriptions taught. There may be many alterations made in the descriptions without departing from the spirit and scope of the present invention.

What is claimed is:

1. A method for providing a downward force on a vehicle powered by an internal combustion engine, comprising steps of:

(a) at an engine exhaust gas outlet port, joining a downforce hammer securely to the port, the hammer closed by a surface positioned at an adjustable step distance below the lowest extremity of the port, such that exhaust gases leaving the port expand over said step distance before striking the closed downward-facing surface of the downforce hammer in the downward direction, the hammer open in the upward direction; and (b) operating the engine to produce exhaust gases exiting the exhaust port, such that the exhaust gases expand freely in both an upward and downward direction;

wherein in step (b), the downwardly expanding exhaust gases strike the closed downward surface of the hammer, creating a downward force imposed upon the hammer, said downward force thus transferred to the port, engine and vehicle.

2. The method of claim 1 wherein, in step (a) a plurality of downforce hammers are joined to a plurality of exhaust ports of the engine.

3. The method of claim 1 wherein the downforce hammer is a section of tubing cut an angle.

4. A downforce hammer for creating a downward force on a vehicle powered by an internal combustion engine, comprising:

an upward-facing opening and a downward-facing closed surface; and an interface for joining the hammer securely to an exhaust port of the internal combustion engine at an adjustable step distance below the lowest extremity of the port, such that exhaust gases leaving the port expand over said step distance before striking the closed downward-facing surface of the downforce hammer;

wherein upon the exhaust gases leaving the exhaust port and expanding freely in both an upward and downward direction, the downwardly-expanding gases strike the closed downward-facing surface of the hammer, creating a downward force imposed upon the hammer, said downward force thus transferred to the port, engine and vehicle.

5. The hammer of claim 4 comprising a section of tubing cut an angle.

6. A downforce system for a vehicle powered by an internal combustion engine, comprising;

one or more downforce hammers, each hammer having an upward-facing opening and a downward-facing closed surface and;

an interface for joining the hammer securely to an exhaust port of the internal combustion engine at an adjustable step distance below the lowest extremity of the port, such that exhaust gases leaving the port expand over said distance before striking the closed downward-facing surface of the downforce hammer;

wherein upon the exhaust gases leaving the exhaust ports and expanding freely in both an upward and downward direction, the downwardly-expanding gases strike the closed downward-facing surfaces of the hammers, creating a downward force imposed upon the hammers, said downward force thus transferred to the ports, engine, and vehicle.

7. The system of claim 6 wherein the exhaust ports are exit ports from exhaust manifolds.

8. The system of claim 6 wherein the downforce hammers comprise sections of tubing cut an angle.

* * * * *